United States Patent [19]

Callon

[11] 4,061,090

[45] Dec. 6, 1977

[54] PLASTIC PALLET

[75] Inventor: Floyd Raymond Callon, Cincinnati, Ohio

[73] Assignee: Heckethorn Manufacturing Co., Dyersburg, Tenn.

[21] Appl. No.: 694,584

[22] Filed: June 10, 1976

[51] Int. Cl.[2] ..... B65D 19/32

[52] U.S. Cl. ..... 108/51.1; 108/55.5; 206/599

[58] Field of Search ..... 108/51.1, 55.1, 55.3, 108/55.5, 56.1, 56.3, 156, 901; 206/386; 248/188, 188.8; 206/597, 599

[56] References Cited

U.S. PATENT DOCUMENTS

| | | | |
|---|---|---|---|
| 2,614,689 | 10/1952 | Miller | 108/56.3 X |
| 3,101,063 | 8/1963 | Wharton | 108/56.3 X |
| 3,524,415 | 8/1970 | Heiman | 108/55.1 X |
| 3,636,888 | 1/1972 | Angelbeck, Jr. | 108/901 X |
| 3,654,874 | 4/1972 | Skinner | 108/56.1 X |
| 3,654,875 | 4/1972 | Vik | 108/55.3 X |
| 3,835,792 | 9/1974 | Wharton | 108/56.1 |
| 3,868,915 | 3/1975 | Hafner | 108/51.1 |

FOREIGN PATENT DOCUMENTS

| | | | |
|---|---|---|---|
| 1,268,059 | 5/1968 | Germany | 108/55.3 |

*Primary Examiner*—Roy D. Frazier
*Assistant Examiner*—William E. Lyddane
*Attorney, Agent, or Firm*—Dennison, Dennison, Meserole & Pollack

[57] ABSTRACT

A one-piece molded plastic platform having a planar upper load-receiving surface surrounded by a peripheral upwardly projecting flange is supported on a plurality of hardwood skids received within three-sided pockets defined by ribs molded so as to depend from the lower surface of the platform. Selected ones of the ribs are reinforced by molded gussets with each skid being locked in position by interengaging projections or transverse ribs on the platform and sockets or rib-receiving notches defined in the skids, appropriate mechanical fasteners completing the locking of the skids to the platform in a manner whereby there is no exposure of the fasteners. Load tying straps tie the load to the pallet with these straps being properly orientated by seats molded within the pallet flange.

15 Claims, 7 Drawing Figures

PLASTIC PALLET

The invention herein generally relates to pallets, and is more particularly directed to a unique pallet construction incorporating a one-piece molded plastic platform mounted on hardwood skids.

It is a primary object of the invention to provide a pallet capable of accommodating extremely heavy loads in a manner whereby the load is secure and fully protected. For example, in the aluminum industry, a pallet 56 inches in diameter has been found highly effective in supporting a 10,000 lb. roll of aluminum strip. In practice, the roll of aluminum, valued in excess of $5,000.00, will be centered upon the pallet with the weight resting upon the four skids. After padding and weather protection is applied, heavy banding is installed in each direction and the loaded pallet is ready to be moved. Due to the extremely heavy weight, lift trucks are in most instances used to partially lift the load and then push the load through the plants and into the box cars for transportation.

While plastic pallets are known, in attempts to use such pallets in situations wherein contact is maintained with the floor and the pallet slid therealong, the high friction developed melts the plastic. In an avoidance of this significant problem found with more conventional plastic pallets, the present invention proposes the use of hardwood skids which, upon a partial lifting of the load by the lift equipment, slide over the floor surface without being adversely affected by the high friction or the heat developed thereby.

The use of a plastic platform is also considered particularly significant in the the usual problems associated with all wood pallets, such as nails loosening and damaging the load, slats breaking and dumping the load, the fact that such pallets are only utilized for a single trip, and the extra shipping weight of all wood pallets, are all eliminated. It is contemplated that pallets constructed in accordance with the invention herein can be effectively loaded, shipped, returned, reloaded and reshipped for up to 10 trips as opposed to wood pallets which, because of the weight factors and the tendency for such pallets to loosen or break, are normally capable of only single use.

Other objects of the invention include the utilization of a molded plastic platform incorporating a planar upper surface capable of accommodating the load without concern with accommodating the load to projections, ribs, sockets or pockets as frequently occur on the plastic pallets heretofore developed.

Another object of the invention resides in the utilization of a plastic platform in conjunction with hardwood skids wherein the skids are so oriented so as to substantially directly support the pallet load.

Other objects of the invention include the provision of integrally molded ribs and gussets for the supported accommodation of the skids on the under surface of the pallet with the skids being locked to the pallet by concealed mechanical fasteners remote from the load supporting surface of the pallet.

These together with additional objects and advantages will become apparent as the invention is more fully hereinafter described and claimed. Reference is had to the accompanying drawings forming a part hereof wherein like numerals refer to like parts throughout, and in which:

Figure 1:
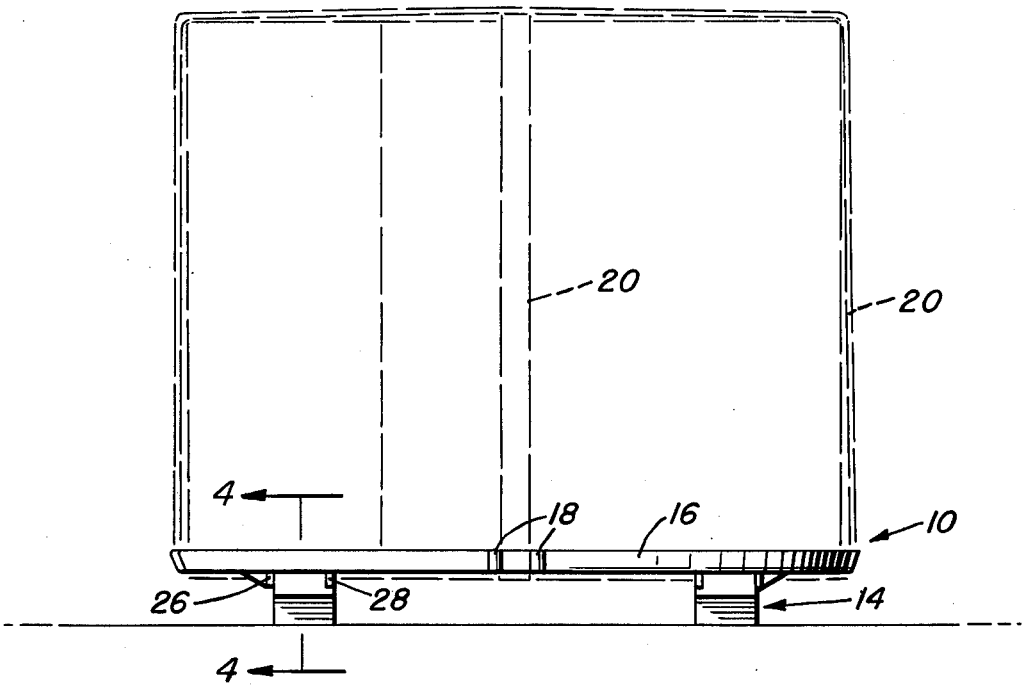
FIG. 1 is a side elevational view of the pallet with a load indicated thereon.

Referring now more specifically to the drawings, reference numeral 10 is used to generally designate the pallet comprising the present invention. This pallet 10 consists of two basic components, a one-piece molded plastic platform 12 and a plurality of hardwood skids 14.

The pallet platform 12 will preferably be vacuum formed from ¼ inch linear polyethylene which can be recycled at such time as the platform becomes worn out. The preferred configuration of the platform is circular as illustrated in FIGS. 1–5 with the pallet presenting a planar upper surface surrounded by an integral upwardly projecting peripheral retaining flange 16. The peripheral flange 16, which angles slightly outward, is provided with four pairs of projections 18 orientated at 90° spacings about the platform 12 so as to define two sets of opposed seats for the reception of load tying straps 20 therein. As will be appreciated, the projections of each pair of projections 18 are laterally spaced from each other a distance so as to closely receive and properly orientate the banding straps.

Figure 3:
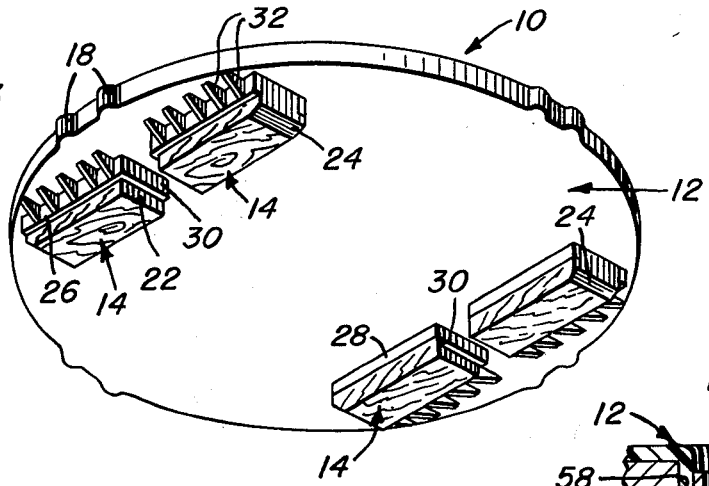
FIG. 3 is a bottom perspective view of the pallet.

Preferably, four of the hardwood skids 14 will be utilized, each of the skids 14 consisting of an elongated block fixed to the under surface of the plastic platform 12. With reference to FIG. 3 in particular, it will be noted that the skids 14 are arranged in two laterally spaced aligned pairs, the skids 14 in each pair being longitudinally aligned with the adjoining inner ends 22 spaced from each other for the reception of a banding strap therebetween. It will of course be recognized that the spaces defined between the inner ends of the respective pairs of skids 14 align with an aligned set of two of the band receiving pairs of projections 18. The outer end of each of the skids 14 will preferably be beveled as at 24 to facilitate movement thereof across a floor surface.

Each of the skids 14 is retained within a pocket defined on the under or lower surface of the platform 12 by three deep vacuum-formed ribs paralleling the opposed longitudinal sides of the corresponding skid 14 and the inner end 22 thereof. These ribs, in association with each skid, include an outer longitudinal rib 26 directed toward the adjacent edge portion of the platform 12, a parallel inner longitudinal rib 28 directed inwardly toward the center of the platform 12 and the other longitudinally aligned pair of skids, and the end rib 30 which will be spaced from a corresponding end rib 30 associated with the pocket retaining the longitudinally aligned skid. Integrally formed gussets 32 extend outwardly from each of the outer ribs 26 to the overlying platform at spaced points along each of the ribs 26 for a structural stabilization thereof. Similar gussets will normally not be provided in association with the inner ribs 28 in order to avoid interference with the introduced lift forks of lift equipment. However, in order to protect the inner ribs 28 from such lift forks, a portion of each of the skids 14, indicated by reference numeral 34, can be outwardly stepped beneath the corresponding inner rib 28 a distance at least parallel to the inner face of the rib 28 to preclude contact of the lift equipment directly with the rib.

Relatively shorter depending vacuum-formed keying ribs 36 are provided transversely between each set of longitudinal ribs 26 and 28 at spaced points along the formed pocket for reception within complementary formed notches 38 defined transverse across the top of the associated skid 14. Preferably, two such rib and notch interlocks 36 and 38 will be provided in conjunction with each mounted skid 14. As will be appreciated, the ribs 36 as well as the previously described ribs and gussets, are in effect formed by spaced walls integrally joined at the lower or bight portion thereof and opening upward through the planar surface of the platform 12. These vacuum-formed ribs and gussets constitute the only break in the planar upper surface of the platform 12 and at no time project above this upper surface so as to interfere with or make difficult the positioning of a load thereon.

Figure 4:
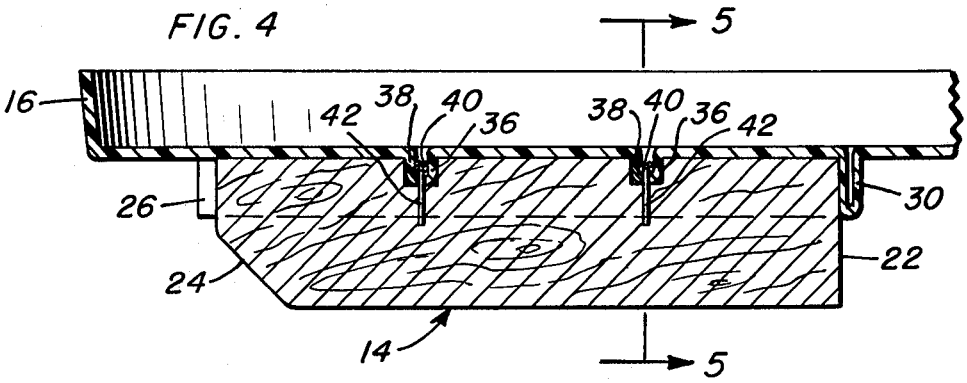
FIG. 4 is an enlarged cross-sectional detail taken substantially on a plane passing along line 4—4 in FIG. 1.
Figure 5:
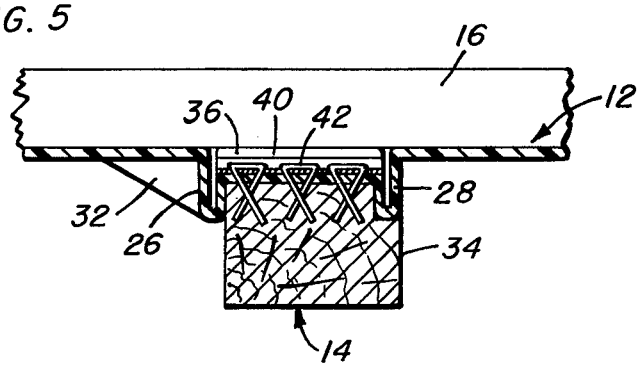
FIG. 5 is a transverse cross-sectional detail taken substantially on a plane passing along line 5—5 in FIG. 4.
Figure 2:
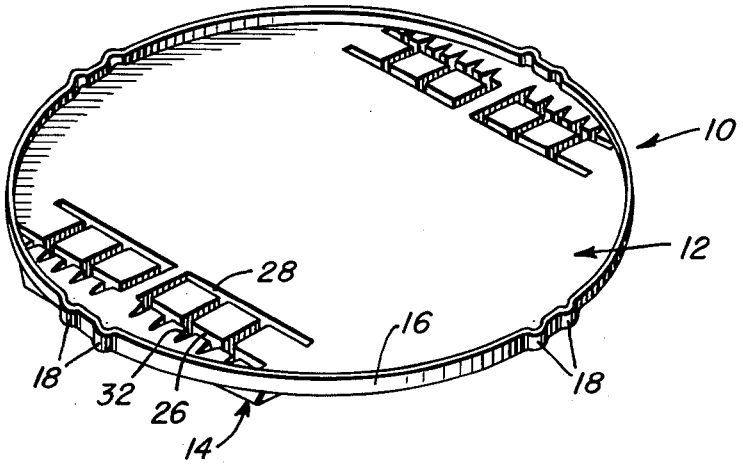
FIG. 2 is a top perspective view of the pallet.

With reference to FIGS. 4 and 5 in particular, it will be noted that each of the transverse keying ribs 36 have an elongated arcuate aluminum reinforcing plate 40 positioned in the lower portion thereof well below the upper planar surface of the platform 12. The actual locking of each skid 14 to the platform 12 is effected by the driving of staples, screws, or the like 42 downwardly through the reinforcing plate 40, underlying rib bottom, and into the skid 14. The particular mechanical fastener 42 utilized will in all cases be positioned within the lower portion of the corresponding transverse keying ribs 36 well below the upper surface of the platform 12 so as to in no way come into contact with the platform received load. Mounted in this manner, it will be appreciated that each skid is not only positively retained and fixed in position by the formed ribs, but is also secured by mechanical fasteners 42 at at least two spaced points along the length of each skid 14. At no time is any metal exposed to the possibility of contact therewith by the load placed upon the pallet.

In use, the load will be positioned on the pallet, normally centered thereon whereby the direct weight of the load is borne by the hardwood skids 14, after which appropriate padding and weather protection is applied. Finally, heavy banding straps are installed in crossed directions. In view of the nature of the plastic pallet platform 12, this platform may flex slightly as required so as to tightly conform the load. However, upon a release of the straps, the pallet immediately returns to its original configuration ready for the next load. Movement of the loaded pallet is then effected utilizing conventional lift truck equipment in a manner whereby a portion of the weight is taken by the lift equipment and the loaded pallet pushed or skidded along the floor. Movement of the load in this manner is normally required due to the substantial weight involved and can only be accommodated, in a plastic pallet, by the use of wood skids. As noted above, conventional plastic pallets, wherein the supports are formed of plastic, have not been able to accommodate the heavy friction developed by movement across the floor surface without a corresponding melting of the plastic. This problem is avoided by the pallet of the present invention while at the same time retaining all of the desirable economic and safety features of a plastic pallet.

Figure 6:
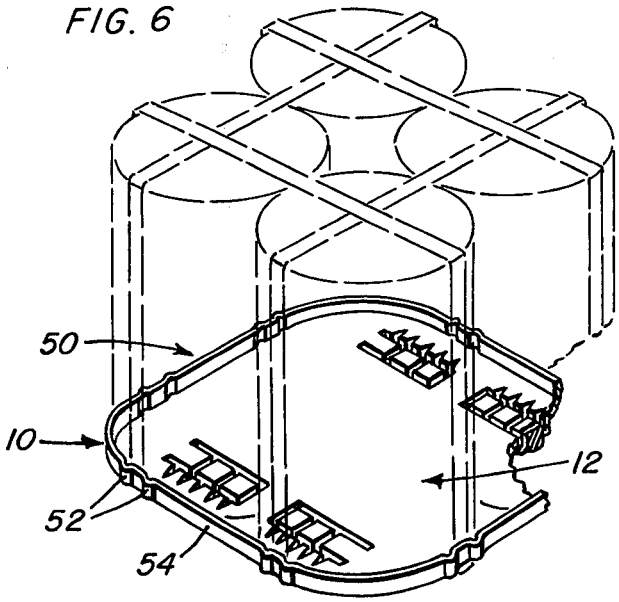
FIG. 6 is a perspective view of a modified form of the pallet.

With reference to FIG. 6, it should be appreciated that while the pallet, in its preferred form, will be circular, square or rectangular pallets 50, incorporating all of the above described features, are also contemplated. Such pallets 50, will be particularly useful in transporting barrels of chemicals, for example, four barrels per pallet, flat stacked material, etc. In each instance, the orientation of the band receiving projections 52 will be such so as to accommodate the particular strap arrangement required for the load involved. Incidentally, the height of the outer flange, referred to by reference numeral 54 in FIG. 6, can vary and, as an example, be of a greater depth when the palletis used in conjunction with chemical barrels and the like so as to provide for a retention of any leakage.

Figure 7:
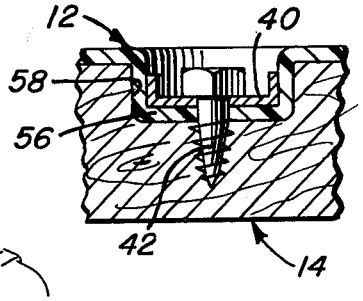
FIG. 7 is a cross-sectional detail of another manner of locking the skids to the pallet.

FIG. 7 illustrates a variation in the manner of locking the individual skids 14 to the pallet. In this instance, rather than using the aforedescribed ribs and notches 36 and 38, the pallet platform 12 is provided with circular depending projections 56 received within corresponding bores 58 defined in the underlying skids 14. In each instance, the appropriate fastener 42 will engage through the bottom of the projection 56 and into the skid 14 in a manner so as to be well below the upper planar surface of the platform 12. An appropriate reinforcing plate 40 will also of course be used.

Also, while not illustrated in the drawings, should an additional load carrying capability be required, such as when carrying coils of steel rather than aluminum, two additional skids can be aligned along the center line of the pallet platform. In such instance, the aforedescribed reinforcing gussets 32 will not be used so as to avoid any interference with the lift forks.

The foregoing is considered illustrative only of the principles of the invention. Since modifications and changes may readily occur to those skilled in the art, it is not desired to limit the invention to the exact construction and operation shown and described. Accordingly, all suitable modifications and equivalents may be resorted to, falling within the scope of the invention as claimed.

What is claimed is:

1. A pallet comprising a one-piece molded plastic platform having a planar upper load-receiving surface and a lower surface, a plurality of elongated wood skids underlying and engaged with selected portions of the lower surface of the plastic platform, said skids being in laterally spaced generally parallel relation to each other and presenting floor engaging, unencumbered planar bottom surfaces, the skids defining sliding supports for said platform of a height and spaced for the accommodation of lift equipment below said platform, and means for fixing the wood skids to the lower surface of said platform, said means for fixing the skids to the platform comprising upwardly opening notches transversely across the upper portions of the wood skids, integral hollow ribs depending from the corresponding selected portions of the lower surface of the platform and completely received within each said skid notch, each rib being elongated and substantially coextensive with the corresponding notch, fasteners engaged through said notch-received ribs and into the skids, the selected portions of the lower surface of the platform, other than said ribs, presenting planar surfaces coextensive with and engaged flat against the tops of the skids, said molded plastic platform being capable of slight flexure so as to comform to a superimposed load upon the application of banding straps about the platform and load.

2. The pallet of claim 1 wherein each wood skid includes more than one of the upwardly opening rib-receiving notches transversely thereacross, the notches in each skid being longitudinally spaced along the length of the skid.

3. The pallet of claim 2 wherein the wood skids are oriented toward opposed edge portions of the platform with each skid including an outer side directed toward the adjacent edge portion of the platform and an inner side directed toward the center of the platform, integral retaining ribs depending from the lower surface of the platform and positioned along the inner and outer sides of each of said skids for a stabilization and retention of the skid, said retaining ribs terminating above the bottom surface of the associated skid.

4. The pallet of claim 3 including integrally formed strengthening gussets extending between each outer side rib and the platform thereabove and immediately outward thereof.

5. The pallet of claim 4 including a first set of opposed band-receiving seats defined in the peripheral edge of the platform, and a second set of opposed band-receiving seats defined in the peripheral edge of the platform at approximately 90° to the first set of band-receiving seats.

6. The pallet of claim 5 including an integral retaining flange projecting upwardly from the upper load-receiving surface peripherally about said platform.

7. The pallet of claim 6 wherein four skids are utilized, said skids being orientated in two laterally spaced aligned pairs of skids with the skids in each pair being longitudinally aligned, the adjoining inner ends of the skids of each pair being spaced from each other for the accommodation of a banding strap therebetween.

8. The pallet of claim 7 wherein one set of opposed band-receiving seats is orientated in alignment with the spaces between the inner ends of the skids.

9. The pallet of claim 6 wherein each skid, along the inner side thereof, includes a portion thereof projecting laterally to underly and protect the associated inner side rib.

10. The pallet of claim 6 including a metal reinforcing plate positioned within each notch-received rib, the associated fastener engaging through the reinforcing plate, each fastener being oriented completely below the load-receiving upper surface of the platform.

11. The pallet of claim 4 including an integral retaining flange projecting upwardly from the upper load-receiving surface peripherally about said platform.

12. The pallet of claim 11 wherein each skid, along the inner side thereof, includes a portion thereof projecting laterally to underly and protect the associated inner side rib.

13. The pallet of claim 3 wherein each skid, along the inner side thereof, includes a portion thereof projecting laterally to underly and protect the associated inner side rib.

14. The pallet of claim 13 including integrally formed strengthening gussets extending between each outer side rib and the platform thereabove and immediately outward thereof.

15. The pallet of claim 4 wherein said platform is of ¼ inch polyethylene.

* * * * *